US005138728A

United States Patent [19]

Aston

[11] Patent Number: 5,138,728

[45] Date of Patent: Aug. 18, 1992

[54] INTERIOR CONTAINER INSERT FOR ANY PILLOW, CUSHION, OR STUFFED TOY

[76] Inventor: Joan F. Aston, 308 Commonwealth Ave. (5J), Boston, Mass. 02115

[21] Appl. No.: 425,014

[22] Filed: Oct. 23, 1989

Related U.S. Application Data

[63] Continuation of Ser. No. 207,531, Jun. 16, 1988, abandoned.

[51] Int. Cl.[5] ..... A47C 20/02

[52] U.S. Cl. ..... 5/645; 5/462

[58] Field of Search ..... 5/436, 442, 462, 490, 5/485, 434

[56] References Cited

U.S. PATENT DOCUMENTS

| | | | |
|---|---|---|---|
| 2,962,731 | 12/1960 | Bounds | 5/442 |
| 3,139,632 | 7/1964 | Johns | 5/442 |
| 3,274,623 | 9/1966 | McCarthy | 5/485 |
| 4,365,371 | 12/1982 | Boussaroque | 5/462 |
| 4,712,259 | 12/1987 | Chiasson | 5/490 |
| 4,754,512 | 7/1988 | Chao-Yang | 5/485 |
| 4,864,669 | 9/1989 | Jones | 5/490 |

FOREIGN PATENT DOCUMENTS

| | | | |
|---|---|---|---|
| 1023202 | 1/1958 | Fed. Rep. of Germany | 5/485 |

*Primary Examiner*—Gary L. Smith
*Assistant Examiner*—Michael J. Milano

[57] ABSTRACT

The interior container insert for any pillow, cushion, or stuffed toy consists of an insert bag with an anchor which can be inserted into and anchored to any of the above forms. The insert bag is pressed into a hollow of typical pillow, cushion, or stuffed toy and has space for the storage of articles of a personal private nature and/or valuables and provides a passive security for same. Once inserted and anchored to the forms described above, it is covered with an exterior casing of any decorative or functional material to camouflage its presence within. The interior container insert is removable, flexible, washable, and replaceable.

10 Claims, 4 Drawing Sheets

INTERIOR CONTAINER INSERT FOR ANY PILLOW, CUSHION, OR STUFFED TOY

REFERENCES CITED

U.S. Patent Documents

| | | | |
|---|---|---|---|
| 1677743 | 7/1928 | Berton | 5/442 |
| 2962731 | 12/1960 | Bounds | 5/442 |
| 3222694 | 12/1964 | Schneck | 5/442 |
| 3253861 | 5/1966 | Howard | 5/442 |
| 3308489 | 3/67 | Winkler | 5/442 |
| 3863283 | 2/75 | Mohr | 5/442 |
| 4185673 | 1/1980 | Daniello | 5/442 |
| 4277859 | 7/1981 | Seaman | 5/442 |

BACKGROUND OF THE INVENTION

1. Field of the Invention

It is well known that it has become increasingly necessary to secure one's personal articles of a private nature, and/ or valuables in the home through passive or active means. This necessatates additional provisions for security other than the traditional means now currently available, e.g., safes, electronic devices, etc., which are often costly as well as being obvious targets for intruders. The present invention would be available at modest cost and would not, because of the innocent looking camouflage (pillow, cushion, or stuffed toy) into which it is inserted, be a likely target for intruders. It is apparent that a need exists for an additional passive security such as would be provided by this INTERIOR CONTAINER INSERT which, once inserted into the middle of any pillow, cushion, or stuffed toy which has a decorative, functional, or playful outer casing, is undetectable to the eye and can provide space for the storage of personal articles of a private nature and/or valuables and may be in continuous use within the home. The INTERIOR CONTAINER INSERT which can be inserted into any pillow, cushion, or stuffed toy many be adapted to any size of the above and may also with ease be removed, washed, and replaced in same whenever necessary, without cutting, sewing, or otherwise altering the pillow, cushion, or stuffed toy within which it has been inserted. The INTERIOR CONTAINER INSERT may also be inserted ninety or one hundred and eighty degrees away from any outer decorative or casing zipper used on the pillow, cushion or stuffed toy. Because of all of the above the INTERIOR CONTAINER INSERT is ideally suited to provide for the storage of personal articles or/ and valuables in any pillow, cushion, or stuffed toy and overcomes the limitations described by the prior art.

2. Description of the Prior Art

BERTON, U.S. Pat. No. 1,677,743 describes a combination bag and cushion which may be turned inside out to form a water-proof envelope, normally covered in fabric, closed with a draw cord, and used with a carrying handle. The draw cord provides direct access to the inner compartment. The inner compartment does not exist as a separate entity from the cushion. The bag is only padded on one side and is not intended for two sided use, nor can the space for storage within be removed from the cushion or exist as a separate entity. The bag and cushion are primarily intended for outdoor use, to carry wet gear and provide damp-proof seating.

BOUNDS, U.S. Pat. No. 2,962,731 describes a pillow comprised of padding and a lining or bag insert which is joined to the end portion of the casing and which open together with a resilient means that is deflectable to an open position for access. The object of this pillow is to provide a space for a small radio which could be heard by a person using the pillow in a conventional manner or which could contain such items as hankerchiefs or small valuables. This space cannot be removed from the pillow and exist as a separate entity, nor can the pillow be any size or of any padding because such would limit one's ability to hear a radio within. The limited padding means that articles within could be felt by anyone touching the pillow, therefore limiting its value as a place of concealment for valuables. The pillow casing and the interior bag are permanently attached at a joint opening, therefore when the pillow is opened the hollow core is opened at the same time, revealing the contents within, hardly a secure place for valuables. Additionally, since insert and pillow are attached, the insert can not be readily removed, washed, and replaced.

SCHNECK, U.S. Pat. No. 3,222,694 describes a portable seat cushion.

HOWARD, U.S. Pat. No. 3,253,861, describes an inflatable cushion for use as a back rest and having provision for ventilation.

WINKLER, U.S. Pat. No. 3,308,489 describes a cushion for resting the legs.

MOHR, U.S. Pat. No. 3,863,283 describes a pillow developed primarily to carry first aid equipment in a vehicle, usually stored on a rear window platform or slipped under the seat.

DANIELLO, U.S. Pat. No. 4,185,673 describes an open-ended bag and cushion for carrying articles and which is equipped with handles. When articles are removed from the bag it may also be used as a cushion. It is not intended to secure articles or valuables and the inner compartment is permanently attached to the bag and cannot be removed and replaced.

SEAMAN, U.S. Pat. No. 4,277,859 describes an inflatable traveling pillow with a carrying handle cover. The pillow, when not in use, may be reduced in size and stored. The pillow described does not provide for the storage of articles or valuables, it must be inflated with a pneumatic pump, has a carrying handle, is not intended for continuous use, may not be used on both sides, and is not intended for home use.

The present invention, the INTERIOR CONTAINER INSERT, has none of the limitations of the Prior Art as stated above, and in fact overcomes all the stated limitations and constitutes a new and improved means for storing articles and/or valuables in any pillow, cushion, or stuffed toy for the purpose of passive security.

SUMMARY OF THE INVENTION

A primary object of the present invention is to provide instant storage and a passive security for personal articles of a private nature and/or valuables.

Another object of the present invention is to provide an INTERIOR CONTAINER INSERT that can be inserted into any pillow, cushion, or stuffed toy with an outer decorative or functional or playful casing.

Yet another object of the present invention is to provide a storage compartment for personal articles of a private nature and/or valuables that would be in continuous use in the home.

The foregoing and other objects of the invention which will become apparent hereinafter, are attained by providing an INTERIOR CONTAINER INSERT that can be adapted and inserted into any pillow, cushion, or stuffed toy.

The INTERIOR CONTAINER INSERT is not limited in size and the storage system is composed of an INTERIOR CONTAINER INSERT inserted into any pillow, cushion or stuffed toy which is then ideally covered with a decorative, functional or playful outer casing. The INSERT can be made of any soft material, but the recommended material is cotton and polyester fabric. The Insert is closed by interlocking fabric closures which adhere to each other such as Velcro. No metal interior pieces are used. It is then anchored to the pillow, cushion, or stuffed toy with a readily removable material such as a cotton sleeve, or bands of Velcro or similar interlocking adherents.

Advantages of the present invention over the Prior Art include but are not limited to:

1. There are no limitations as to the size of the present invention and therefore it can be inserted into any pillow, cushion, or stuffed toy.
2. The INTERIOR CONTAINER INSERT is designed for continuous use and is not to be stored, folded, inflated, nor used as a bag with a carrying handle, nor does it interfere with the normal function of a comfortable pillow, cushion, or stuffed toy into which it is inserted.
3. The INTERIOR CONTAINER INSERT once inserted into any pillow, cushion, or stuffed toy may be covered with many different and changing outer casings and is independent of them.
4. The INTERIOR CONTAINER INSERT may be removed from the pillow, cushion, or stuffed toy readily and with ease, and may be washed and replaced.
5. The INTERIOR CONTAINER INSERT has its own closure system which is independent of any decorative or functional casing with closure with which it may be covered and disguised.
6. The INTERIOR CONTAINER INSERT is therefore not attached in any way to the outer decorative or functional casing of the pillow, cushion, or stuffed toy, so it does not open when the casing is opened.
7. The INTERIOR CONTAINER INSERT, once in place on the pillow, cushion, or stuffed toy may be encased in any decorative or functional casing and the INSERT opening can be place ninety or one hundred and eighty degrees away from the casing opening thus further protecting it from detection by the casual observer.
8. The INTERIOR CONTAINER INSERT, once in place in the pillow, cushion, or stuffed toy with a decorative or functional casing may be removed from said casing along with the pillow, cushion, or toy form with ease, and so the outer casings may be renewed or changed as desired.
9. The INTERIOR CONTAINER INSERT has no interior metal parts, or any hard parts, e.g., springs or fasteners to keep the bag open. Such metal or hard parts as described in the Prior Art would be detectable and detract from the primary purpose of the INTERIOR CONTAINER INSERT as a passive hiding place for personal articles of a private nature and/or valuables. Such hard or metal parts would also interfere with the comfortable function of the pillow, cushion, or stuffed toy in which the INTERIOR CONTAINER INSERT is inserted.

BRIEF DESCRIPTION OF THE DRAWINGS

FIG. 1.*a*. is the Pattern for the INTERIOR CONTAINER INSERT BAG.

FIG. 1.*b*. is the Pattern for the INTERIOR CONTAINER INSERT SLEEVE. INTERIOR

NOTE: FIG. 1.*a*. and FIG. 1.*b*. together form the CONTAINER INSERT.

FIG. 2.*a*. is the vertical side view of the INTERIOR CONTAINER INSERT inserted into the pillow form.

DESCRIPTION OF THE PREFERRED EMBODIMENT

A preferred embodiment of the present invention is shown in the accompanying drawings, in which the INTERIOR CONTAINER INSERT as it can be used on a pillow form is shown as it would look without an outer decorative or functional casing.

Figure 1:
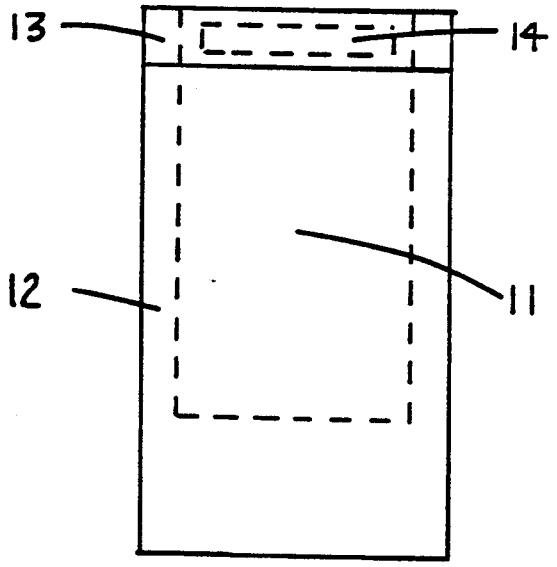
FIG. 1. is the Pattern for the INTERIOR CONTAINER INSERT.

The Pattern for the INTERIOR CONTAINER INSERT is shown in FIG. 1.; it can be seen that the INSERT consists of a BAG 11, inside an Anchor Sleeve 12, with a Flap 13, which is held closed by a Velcro hook and loop fastener or similar closure 14.

The Pattern shown in FIG. 1. *a*. is cut from two thicknesses of fabric with a Fold Line 23 at the bottom. Front and Back views are identical so only the Front View has been shown. Folded together at Fold Line 23, front and back together, Seams 16 and 17 are sewn up both sides to the Stitching Line 15. The Flaps are then folded down in Increments 24 to meet the Stitching Line 15, both Front and Back Flaps being folded in the same manner. Each Flap is then sewed down along its length at the Stitching Line 15, with the short ends of each Flap turned inward and hemmed.

Figure 1A:
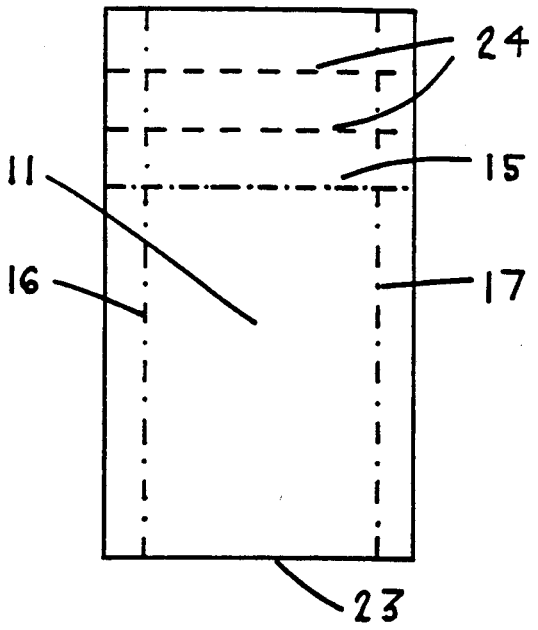
Figure 1B:
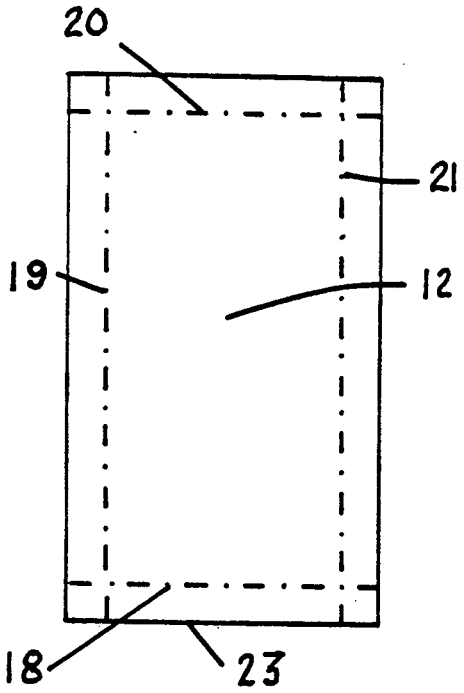

The Pattern for the Anchor Sleeve is shown in FIG. 1*b*. The same Pattern used in FIG. 1*a*. is used in FIG. 1*b*., the dimensions for the Bag and the Anchor Sleeve being identical. The pattern for the Anchor Sleeve is cut from two thicknesses of material placed on a Fold 23. With the length of the material then opened, a Hem 18, 19, 20, 21 is turned under on all four sides and sewn down. With finished edges facing up, the Front Top Anchor Sleeve 12, is sewn to the Bag 11, (See FIG. 1.) along the Stitching Line 15 and just below the line where the Flaps are sewn to the Bag. The top of the Sleeve is now parallel to the length of the Flaps. Now bring Back Top of Sleeve to Back Stitching Line of Bag and attach sleeve to Bag along Stitching Line and just beneath back Flaps in an identical manner.

The Anchor Sleeve and Bag are now connected, with the Bag within the Anchor Sleeve, and Anchor Sleeve outside the Bag, both meeting and joined at the Flaps. A Velcro-like closure can now be sewn to each Flap, front and back, which will seal the opening when desired. This completes the INTERIOR CONTAINER INSERT which now can be inserted into and anchored on a pillow, cushion, or stuffed toy form. The joining of the INSERT to a typical pillow form is as follows: an incision is made along the seam line at the center of one edge of a typical pillow, cushion, or stuffed toy form, said incision providing or access to the interior of the form. Enough filling is then removed from the center of the form to create a hollow within. The Anchor Sleeve of the INTERIOR CONTAINER INSERT is then slipped over the form, enclosing it, and centered over the incision at the Flaps. The Bag which is now also centered over the incision in the form can now be pushed down into the hollow created in the form and the Bag may be extended to its fullest dimensions. Care must be taken that enough filling remains in the form to insure a plump appearance and to prevent the INTERIOR CONTAINER INSERT from being detected.

Figure 2:
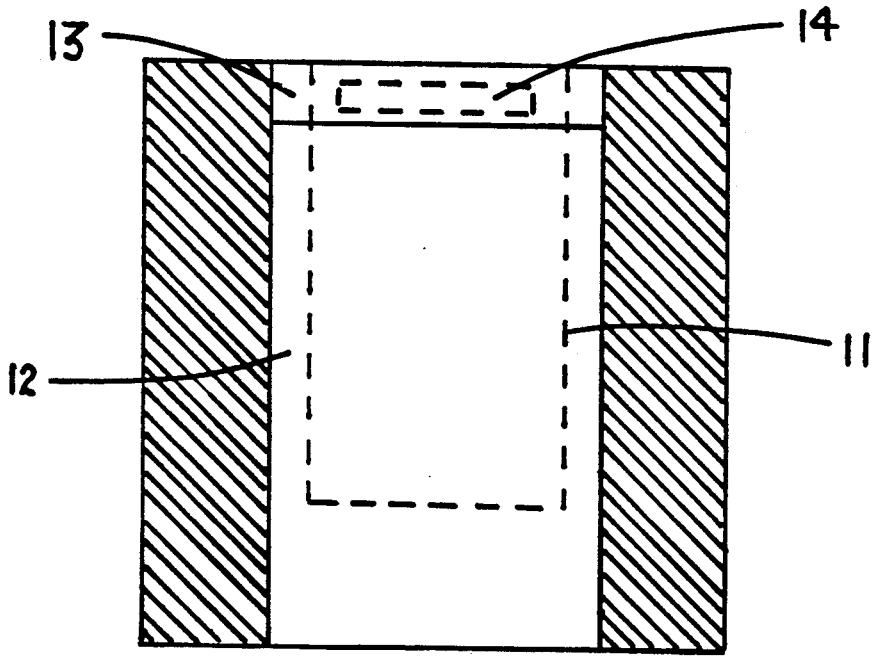
FIG. 2. is the front view of the INTERIOR CONTAINER INSERT anchored to a typical pillow form.
Figure 2A:
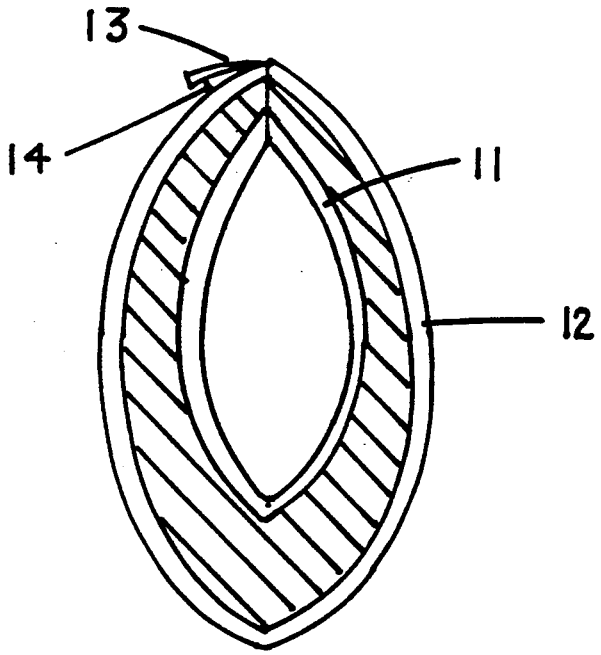

FIG. 2. Shows the INTERIOR CONTAINER INSERT with the Anchor Sleeve 12 encasing a form and acting as an anchor for the Bag 11 which is inserted within the form. The Flap 13 covers the opening and the Velcro-like closure seals it. FIG. *2a*. shows the side view of the INTERIOR CONTAINER INSERT within the form, and the Anchor Sleeve surrounding the form and acting as an anchor for the Bag 11. The Flap 13 is shown as it appears when closed and sealed with Velcro-like closure 14.

Figure 3:
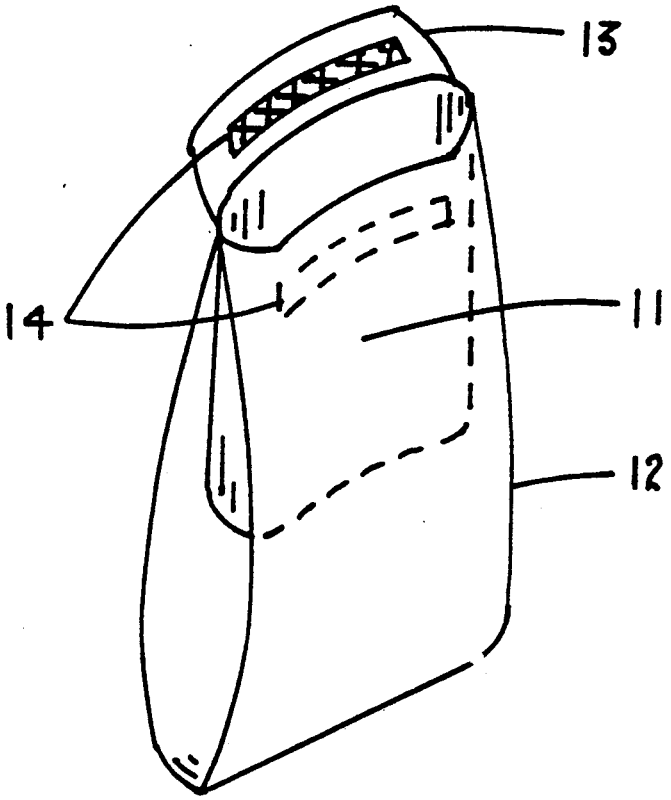
FIG. 3. is a three dimensional view of the INTERIOR CONTAINER INSERT by itself before being inserted into any pillow, cushion, or stuffed toy form.

FIG. 3. shows a three dimensional view of the INTERIOR CONTAINER INSERT with Bag 11 inside Anchor Sleeve 12 and the Flap 13 which is secured by the Velcro-like closure 14. Decorative lace is added to the visible side of the Flap 13.

Figure 4:
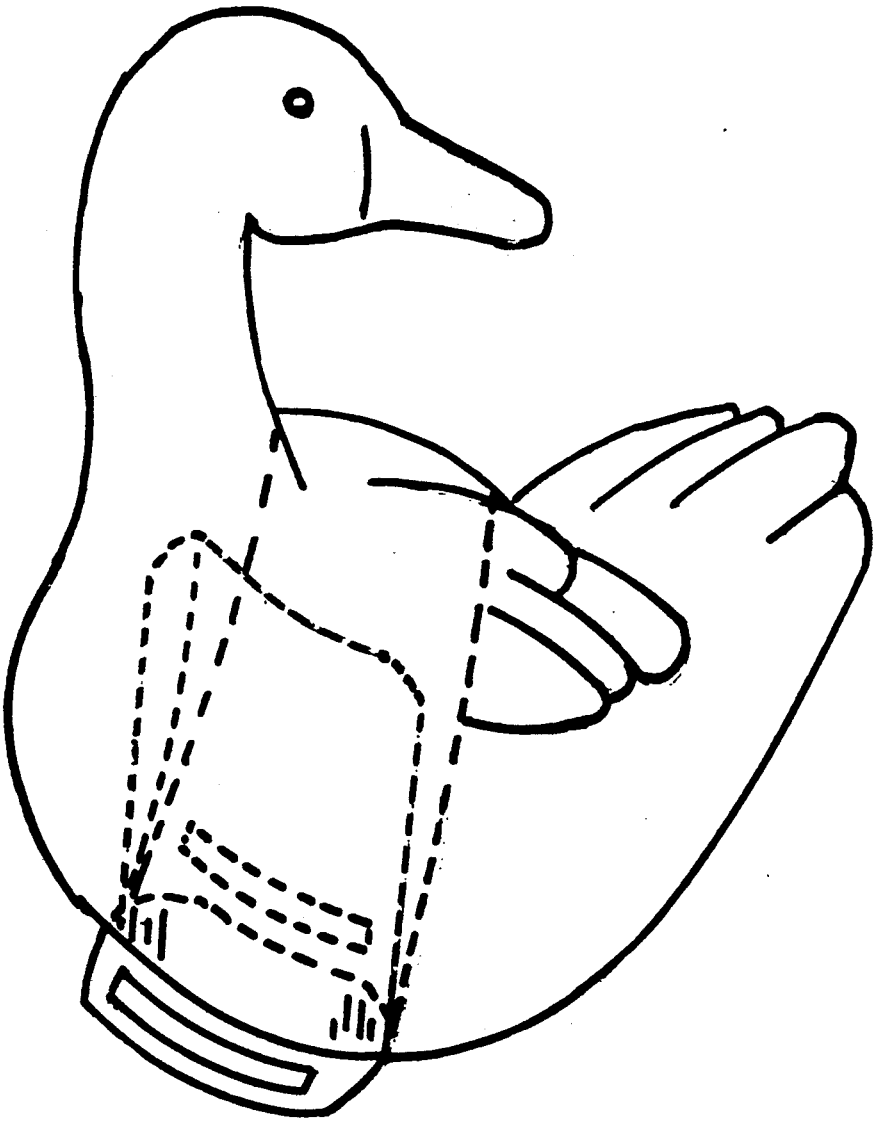
FIG. 4 is the front view of the INTERIOR CONTAINER INSERT within and upon a stuffed toy.

FIG. 4 shows the INTERIOR CONTAINER INSERT within and around a stuffed toy.

After the INTERIOR CONTAINER INSERT is in place on a pillow, cushion, or stuffed toy form, said forms should be covered by a fabric or material casing appropriate to its apparent utilitarian or decorative purpose, ie; for a sleeping pillow a pillow case, for a decorative pillow a decorative fabric, for a chair cushion a utilitarian or decorative fabric, for a sofa cushion a decorative fabric, for a stuffed toy a playful fabric, etc.; any material that would be appropriate to its setting and would conceal the INTERIOR CONTAINER INSERT from the naked eye, and protect its function as a storage place providing passive security for articles of a personal nature and/or valuables.

One advantage of the present invention is that it can be used and inserted into any pillow, cushion, or stuffed toy form and can be used on a continuous basis in any environment. Once on a form, the form and the INSERT may easily be removed from one decorative or functional casing to another, and easily adapted to any environment selected, casings being replacable at will and not at any time restricted by the presence of the INTERIOR CONTAINER INSERT within the form.

Another advantage of the present invention is to provide instant storage for personal articles of a private nature and/or valuables which cannot be detected and whose purpose as such is camauflaged as an ordinary pillow, cushion, or stuffed toy.

In addition, the present invention provides an independent interior container insert which can be removed, washed, and replaced, and whose decorative or functional casing may be replaced, repaired, or cleaned easily and at any time. Still another advantage of the present invention is that the opening for the INTERIOR CONTAINER INSERT may be placed ninety or one hundred and eighty degrees from any casing opening, so that even if such casing is opened the opening or Flaps of the INTERIOR CONTAINER INSERT would not be visible. Additionally, the present invention has no hard or metal parts to interfere with the comfort of any pillow, cushion or stuffed toy in which it is inserted. Nor does the present invention rely on any inflatable criteria. The invention further allows adequate comfortable padding on both sides top and bottom of the form in which it is inserted so that the form may be used for its obvious original purpose. Thus there is disclosed in the above description and in the drawings, an embodiment of the invention which fully and effectively accomplishes the objects thereof.

The invention is not to be limited by the specific disclosure within, but only by the appending claims.

While the present invention has been described with reference to particular embodiments thereof, it will be understood that numerous modifications can be made by those skilled in the art without actually departing from the scope of the invention. Accordingly, all modifications and equivalents may be resorted to which fall within the scope of the invention as claimed.

The embodiments of the invention for which an exclusive privilege or property is claimed are defined as follows:

1. A combination including an article such as a pillow or cushion and a covering anchor sleeve therefor, said article comprising edge surfaces, one of said edge surfaces having an indent therein forming a hollow which extends a substantial distance into said article, said covering sleeve having an open ended insert bag secured adjacent one end thereof, said bag extends into said hollow with said open end of said bag being adjacent said indented edge surface of said article; a portion of said sleeve opposite from said bag extends around said article and is secured to an opposite edge of said bag's open end; a closure flap secured to one end of said sleeve for covering said opening of said bag; said bag having space for the storage of articles therein; said combination having an exterior casing.

2. A combination as claimed in claim 1 wherein said article comprises a toy form.

3. A combination according to claim 1 wherein the purpose of the invention is to provide storage and passive security for personal articles.

4. A combination as claimed in claim 1 wherein said combination is covered by a decorative casing with a closure, said casing concealing said combination within.

5. A combination as claimed in claim 1 wherein said open end of said bag can be placed ninety to one hundred degrees from the opening of said casing.

6. A combination as claimed in claim 1 wherein said covering sleeve and said bag are made of a flexible material.

7. A combination as claimed in claim 1 whereby said covering anchor sleeve and said insert bag are removable from said article for washing.

8. A combination as claimed in claim 1 further comprising a hook and loop closure to seal said closure flap.

9. A combination as claimed in claim 1 wherein the exterior casing is removable and independent from the combination.

10. A combination as claimed in claim 1 whereby said combination covered with said exterior casing is intended for continuous use in the home or elsewhere to provide storage and passive security for personal articles.

* * * * *